US008098838B2

(12) United States Patent
Lee et al.

(10) Patent No.: US 8,098,838 B2
(45) Date of Patent: Jan. 17, 2012

(54) DETECTING THE REPOSITIONING OF AN EARPHONE USING A MICROPHONE AND ASSOCIATED ACTION

(75) Inventors: Jae Han Lee, San Jose, CA (US); Wendell B. Sander, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 548 days.

(21) Appl. No.: 12/277,219

(22) Filed: Nov. 24, 2008

(65) Prior Publication Data

US 2010/0128887 A1 May 27, 2010

(51) Int. Cl.
*H04R 1/10* (2006.01)

(52) U.S. Cl. ..... 381/74; 381/370; 381/384

(58) Field of Classification Search ..... 381/74, 381/370, 380, 384
See application file for complete search history.

(56) References Cited

U.S. PATENT DOCUMENTS

| | | | | |
|---|---|---|---|---|
| 5,712,911 | A | 1/1998 | Her | |
| 5,729,604 | A | 3/1998 | Van Schyndel | |
| 6,104,808 | A | 8/2000 | Alameh et al. | |
| 6,212,282 | B1 * | 4/2001 | Mershon | 381/77 |
| 6,542,436 | B1 | 4/2003 | Myllyla | |
| 6,639,987 | B2 | 10/2003 | McIntosh | |
| 7,054,450 | B2 | 5/2006 | McIntosh et al. | |
| 7,076,204 | B2 * | 7/2006 | Richenstein et al. | 455/3.06 |
| 7,106,865 | B2 | 9/2006 | Pavlovet et al. | |
| 7,187,948 | B2 * | 3/2007 | Alden | 455/557 |
| 2006/0029234 | A1 * | 2/2006 | Sargaison | 381/74 |
| 2006/0045304 | A1 | 3/2006 | Lee et al. | |
| 2006/0060762 | A1 | 3/2006 | Chan et al. | |
| 2006/0233413 | A1 | 10/2006 | Nam | |

FOREIGN PATENT DOCUMENTS

| | | |
|---|---|---|
| EP | 1465454 | 1/2008 |
| KR | 20010048552 | 6/2001 |
| WO | WO-2007/049254 | 5/2007 |

OTHER PUBLICATIONS

EPO Search Report, mailed under Communication dated Feb. 5, 2010, 3 pages.

International Preliminary Report on Patentability, dated Jun. 3, 2011, International Application No. PCT/US2009/064070, International Filing Date—Nov. 11, 2009, (7 pages).

* cited by examiner

*Primary Examiner* — Kevin M Picardat

(74) *Attorney, Agent, or Firm* — Blakely, Sokoloff, Taylor & Zafman LLP

(57) ABSTRACT

A system detects the repositioning of an earphone that is worn by a user, and changes an operation mode of a host coupled to the earphone. Within the earphone is a pressure transducer that detects a pressure change caused by the repositioning of the earphone. A signaling mechanism sends a repositioning detection signal to the host in response to a signal from the pressure transducer indicating the detection of the pressure change.

17 Claims, 5 Drawing Sheets

DETECTING THE REPOSITIONING OF AN EARPHONE USING A MICROPHONE AND ASSOCIATED ACTION

FIELD OF THE INVENTION

The present invention relates generally to an earphone. More particularly, this invention relates to detecting the repositioning of an earphone that is worn by a user.

BACKGROUND

Earphones (also known as earbuds or headphones) are widely used for listening to audio sources for recreation. An earphone contains a receiver (a small speaker) that is held close to the user's ear to convert electric signals into sound. Earphones can be connected to an audio source, such as an audio amplifier or a media player, which resides in stationary equipment (e.g., a CD or DVD player, a home theater, a personal computer, etc.), or in a portable device (e.g., a digital audio player, an MP3 player, a mobile phone, a personal digital assistant, etc.).

An earphone may be combined or integrated with a microphone to form a headset, that is used for two-way communications through a host device, such as a cellular phone, or a desktop or laptop computer executing voice over IP (Internet Protocol) software. The headset can communicate with the host device through either a wired connection or a wireless link.

SUMMARY OF THE INVENTION

A method and system for detecting the repositioning of an earphone is described herein. The system comprises an earphone assembly (earphone) that is to be coupled to a host. Within the earphone is a pressure transducer that detects a pressure change caused by the repositioning of the earphone against the user's ear. Upon detection of the pressure change, the pressure transducer transmits a signal to a signaling mechanism that is also outside the host. The signaling mechanism sends a repositioning detection signal to the host in response to the signal from the pressure transducer. The repositioning detection signal may be superimposed on a microphone output audio signal when it is transmitted to the host.

Upon receipt of the repositioning detecting signal, the host changes its operation mode. In one scenario, the host may include a media player that is connected to the earphone and is playing music through the earphone. The player pauses music playing when the repositioning detecting signal indicates removal of the earphone from the user's ear. The media player may automatically resume music playing when the repositioning detecting signal indicates that the earphone has been re-inserted into the user's ear or is otherwise "at the ear." In another scenario, the host may include a telephone module which automatically switches to speakerphone mode when the repositioning detecting signal indicates the removal of the earphone from the user's ear. The telephone module may switch back to receiver mode (handset mode) when the repositioning detecting signal indicates that the earphone has resumed its at-the-ear position. It is understood that other scenarios, involving different operation modes of the host, may also utilize the repositioning detection signal.

BRIEF DESCRIPTION OF THE DRAWINGS

Embodiments are illustrated by way of example and not by way of limitation in the figures of the accompanying drawings, in which like references indicate similar elements. It should be noted that references to "an" or "one" embodiment in this disclosure are not necessarily to the same embodiment, and such references mean at least one.

DETAILED DESCRIPTION

Figure 1:
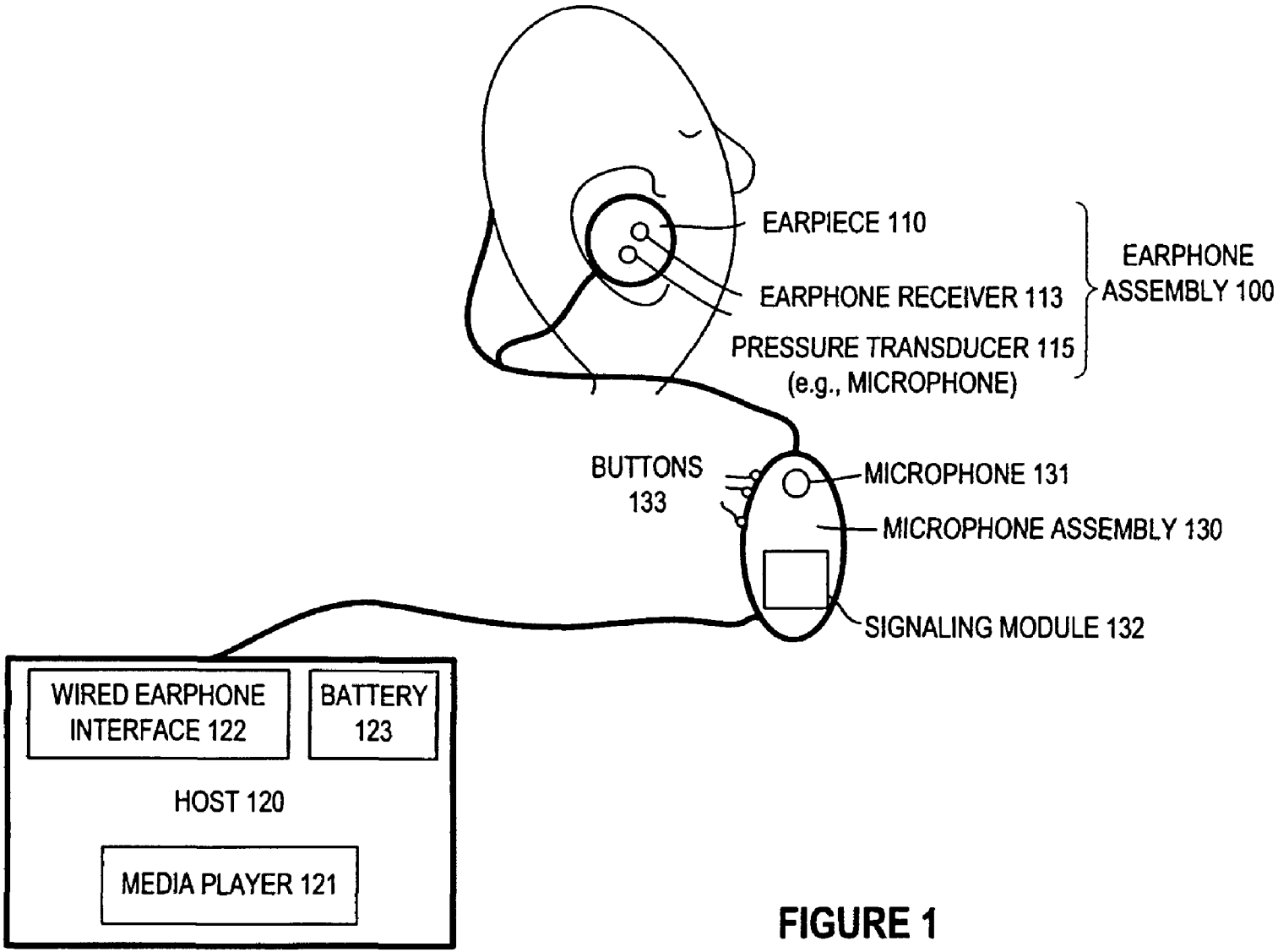
FIG. 1 illustrates one embodiment of an earphone assembly communicating with a host by wires.

FIG. 1 illustrates an embodiment of an earphone assembly 100 and a wired headset 101, connected to a host 120 that contains a signal source, such as a media player 121. Earphone assembly 100, in this example, includes a pair of earpieces 110 to be held close to a user's ears. Earpieces 110 may be held inside the ears (such as earbuds or in-the-ear earphones), or outside but in close proximity of the ears. When placed in the ears, earpieces 110 may be positioned outside the ear canals, or within the ear canals with the ear canals entirely or partially sealed. In the embodiment shown in FIG. 1, earpieces 110 are connected to host 120 by wires (or cables). The wires carry electric signals representative of sound (audio signals) into earpieces 110. One end of the wires has a plug (not shown) to be plugged into a mating jack 125 of host 120. Each earpiece 110 contains an earphone receiver 113, which can also be referred to as an earphone speaker, for converting the electric signal into sound to be heard by the user.

According to one embodiment of the present invention, each of earpieces 110 also contains a pressure transducer 115 that converts a pressure change in the ear into a voltage or current change. The pressure change may be produced by removing earpiece 110 from, or placing earpiece 110 against or into, the user's ear that wears the earpiece. In one embodiment, pressure transducer 115 is a microphone, such as an MEMS (Micro-Electro-Mechanical Systems) microphone that detects an ambient pressure change.

In the embodiment, pressure transducer 115 generates a transducer signal to carry a voltage change to host 120. The transducer signal can be sent to host 120 through a dedicated wire, or can be multiplexed with or superimposed on an audio signal, in the same wire that carries electric audio signals (e.g., music) from or to the host 120.

In the embodiment shown in FIG. 1, the transducer signal carrying the voltage change is sent from the earphone assembly 100 to a microphone assembly 130 of the headset 101, through a separate wire (separate from the wire for the left receiver and the wire for the right receiver). The microphone assembly 130 then forwards the transducer signal to host 120 in the same or a different signaling format. In one embodiment, microphone assembly 130 comprises a microphone 131 for converting a sound (e.g., the user's speech) into electric signals for transmission to host 120. The microphone assembly 130 also comprises a signaling module 132 for generating a repositioning detection signal in response to the transducer signal, and one or more buttons 133 that can be programmed to control specific tasks. For example, buttons 133 can be used to turn on/off the microphone 131, signal the host to adjust the volume of the music it is playing through the earphone assembly 100, or disconnect an ongoing telephone call. A button press signal is generated and transmitted to host 120 by the signaling module 132, when one of buttons 133 is pressed.

In one embodiment, the repositioning detection signal is transmitted to host 120 on the same wire as the electric signal generated by microphone 131 (referred to as a microphone signal). The frequency of the microphone signal falls in an audible frequency range. Signaling module 132 may transmit the repositioning detection signal as a DC voltage level when microphone 131 is not present or is not in use. When microphone 131 is in use, signaling module 132 may transmit the repositioning detection signal as a supersonic AC signal which is superimposed on the microphone signal. An embodiment of signaling module 132 will be described in greater detail with reference to FIG. 3.

In one embodiment, host 120 comprises a media player 121, a wired earphone interface 122, and a battery 123. In alternative embodiments, host 120 may comprise some, but not all of the components shown in FIG. 1. For example, although battery 123 is shown in FIG. 1, it is understood that host 120 may be a desktop computer or a stationary device that is powered by a standard electric outlet instead of a battery. Host 120 may be, for example, a personal computer (PC), a mobile phone, a palm-sized computing device, a personal digital assistant (PDA), a media playing device such as an iPod™ device, or a gaming device.

Media player 121 may be viewed as a source of the electric audio signal that will be delivered to the input of the earphone receiver 113. In one embodiment, media player 121 is a software program for playing streamed or stored multimedia files, such as audio and video files. Examples of a software media player include the following brands of personal computer application programs: iTunes™, Windows Media Player, Quicktime, and RealPlayer. Alternatively, media player 121 may comprise dedicated hardware, or a combination of dedicated hardware and software such as an iPod™ player.

Wired earphone interface 122 converts a digital audio signal into an analog audio signal for transmission to earphone assembly 100. Wired earphone interface 122 also receives the repositioning detection signal, as a distinct or unique voltage level or a supersonic signal, and invokes a change in the operation mode of media player 121 or host 120. For example, media player 121 can be paused when it is in a play mode, or can resume playing when it is in a pause mode. Host 120 can switch from a receiver mode into a speaker mode, or vice versa, upon receipt of the repositioning detection signal. Wired earphone interface 122 is powered and controlled by host 120.

Figure 2:
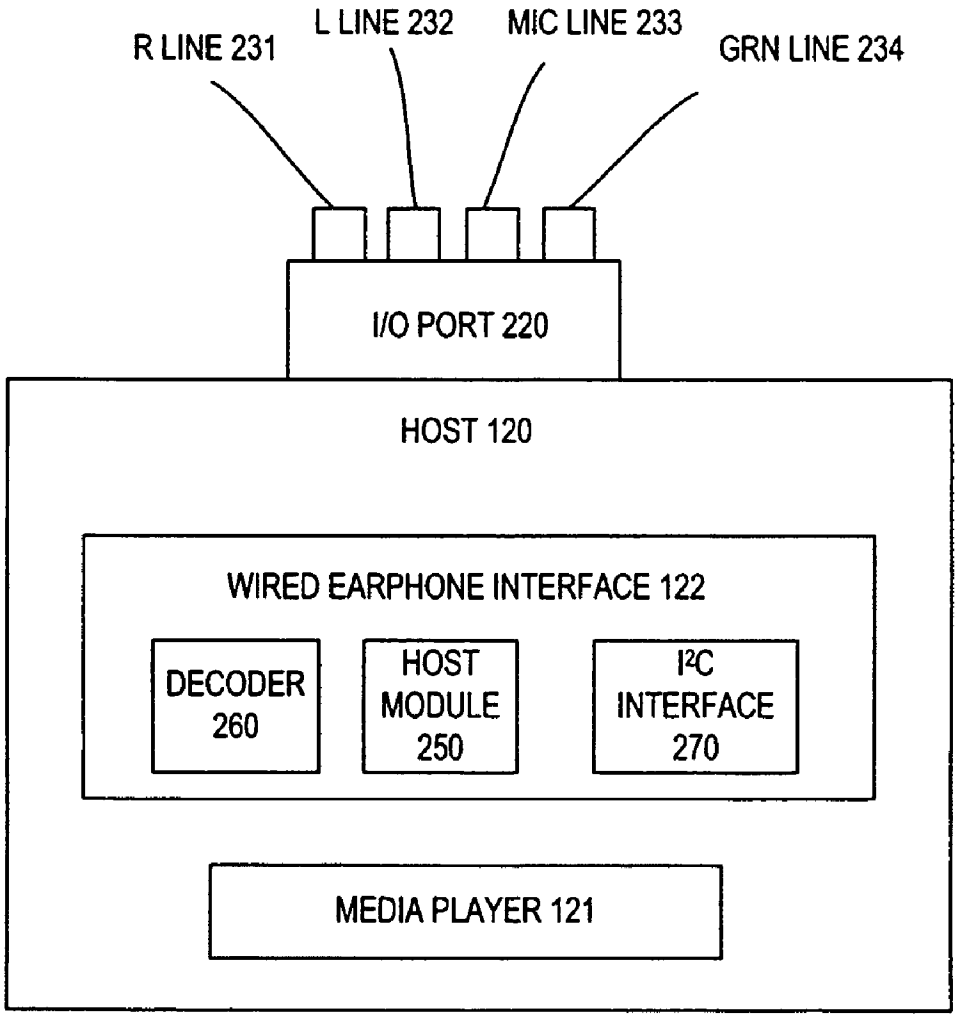
FIG. 2 illustrates an embodiment of an I/O port of a host through which a wired connection can be established between the host and the earphone assembly.

The connection between the wired headset 101 and the wired earphone interface 122 of the host 120 may be through an I/O port 220, depicted in FIG. 2. I/O port 120 may be located in jack 125 of FIG. 1. In this embodiment, four lines or wires are shown to pass through I/O port 220. A first line (labeled "R") 231 carries electric audio signal representative of sound to the right earpiece 110, and a second line (labeled "L") 232 carries electric audio signal representative of sound to the left earpiece 110. The output signals on these two lines may be different for stereophonic sound, or may be the same for monotonic sound. A third line (labeled "MIC") 233 carries the microphone signal, and one or more button press signals, into host 120. MIC line 233 also provides power to microphone assembly 130. A fourth line (labeled "GRN") 234 provides a ground voltage to microphone assembly 130. In this embodiment, the repositioning detection signal is carried by the MIC line 233 in accordance with the technique described below in connection with FIG. 3.

FIG. 2 also illustrates an embodiment of the components within wired earphone interface 122. In this embodiment, wired earphone interface 122 includes a host module 250, a decoder 260, and an $I^2C$ interface 270. Host module 250 provides regulated downstream power to signaling module 132 and microphone 131. Decoder 260 decodes the button press signal and the repositioning detection signal (from microphone assembly 130), and provides the decoded information to host 120 via an interface, e.g., an I2 C interface 270. The decoded information causes host 120 to change its operation mode or to perform other pre-programmed tasks according to the pressed button.

Figure 3:
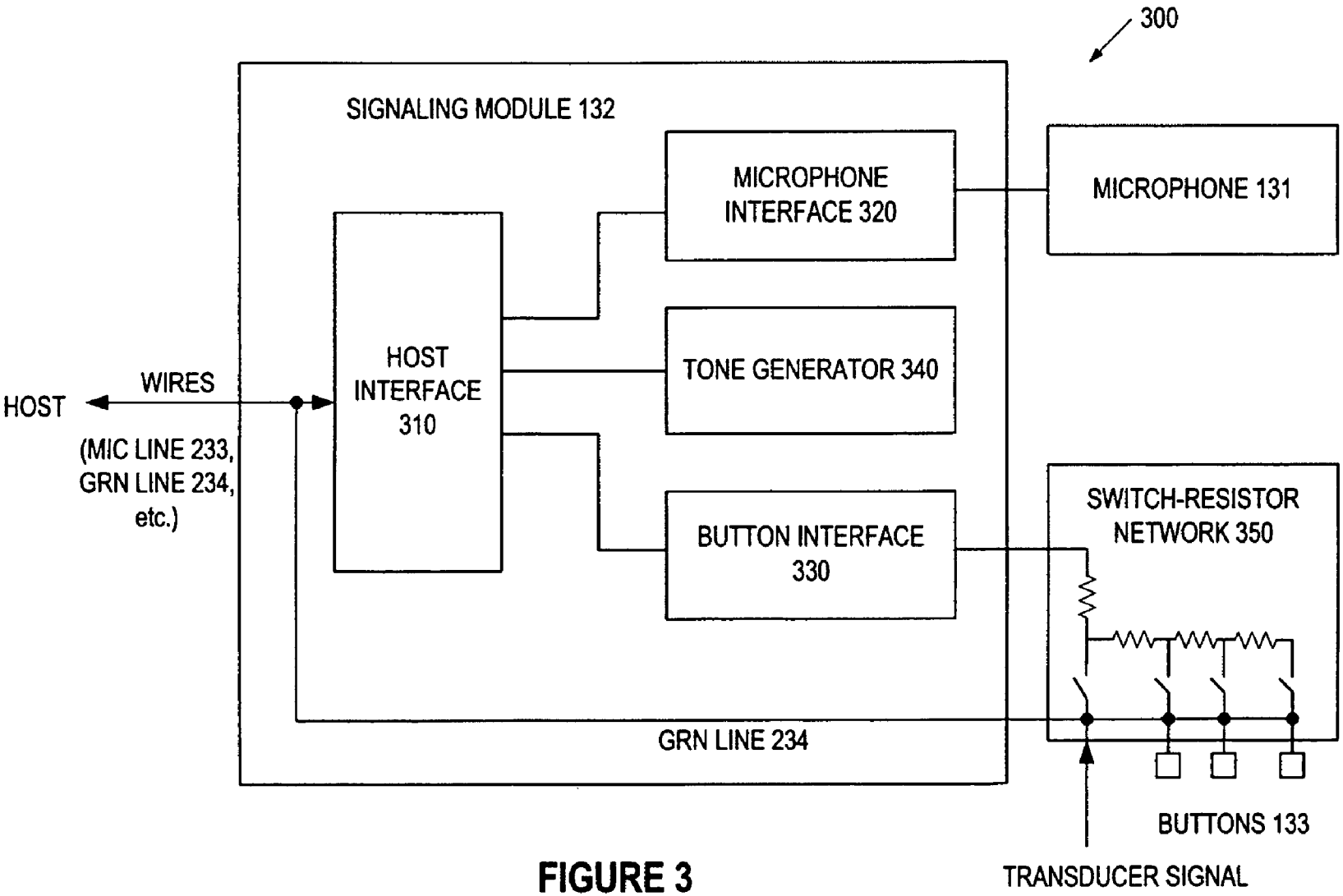
FIG. 3 illustrates an embodiment of a signaling module as part of a wired headset assembly.

FIG. 3 illustrates a block diagram of an embodiment of signaling module 132. Signaling module 132 includes a host interface 310, a microphone interface 320, a button interface 330 and a tone generator 340. Host interface 310 communicates with host 120 via MIC line 233 and GRN line 234 (of FIG. 2). In this embodiment, it is not necessary for R line 231 and L line 232 to enter signaling module 132, as the destination for the sound signals on these lines is earphone assembly 110. Via MIC line 233, host interface 310 sends the microphone signal, the button press signal and the repositioning detection signal to host 120, and receives power from host 120. The power from host 120 is used to power up or bias the microphone 131 and operate the signaling module 132. Via GND line 234, host interface 310 receives a ground voltage from host 120.

Microphone interface 320 receives signals from microphone 131 and forwards the microphone signal to host 120 via host interface 310. Microphone interface 320 also detects the presence and usage of microphone 131, and provides an indication to host interface 310 as to whether microphone 131 is present or in use. Button interface 330 is coupled to a switch-resistor network 350, which includes a series of resistors, each coupled to a switch. The switches are controlled by buttons 133, except that one of the switches is controlled by the transducer signal. Button interface 330 forwards the detection of a button press and the detection of a transducer signal to host interface 310.

When microphone 131 is not in use or is not present, signaling module 132 enters a button mode, in which the press of buttons and the presence of a transducer signal are transmitted to host 120 through MIC line 233 using discrete voltage levels. During operation in the button mode, signaling module 132 operates as a pass through element, which connects switch-resistor network 350 onto MIC line 233. When one of buttons 133 is pressed, the DC voltage level on MIC line 233 is changed and detected by wired earphone interface 122 of host 120. A distinct DC voltage level is generated when a different button is pressed. When a transducer signal is received, another distinct DC voltage level is generated to provide a repositioning detection signal to host 120. In one embodiment, when a change of the DC level on MIC line 233 is detected, wired earphone interface 122 translates the frequency sequence into a button press or a repositioning of an earphone. Wired earphone interface 122 places the translated result in registers and sets an interrupt. Host 120 reads these registers to determine into which operation mode the host should change.

Still referring to FIG. 3, when microphone interface 320 detects the presence of a microphone signal, e.g. speech pick up, signaling module 132 enters a tone mode. During operation in the tone mode, tone generator 340 generates a discrete frequency (AC) sequence onto MIC line 233 in response to the detection of a button press or the detection of a transducer signal. The frequency sequence is unique to each button press. When a transducer signal is received, another unique frequency sequence is generated to provide a repositioning detection signal to host 120. Wired earphone interface 122 of the host 120 (FIG. 1) detects and uses the frequency sequence on MIC line 233 to determine the occurrence of a specific button press or a repositioning of the earphone. When a distinct frequency sequence is detected on MIC line 233, wired earphone interface 122 translates the frequency sequence into a button press or a repositioning of the earphone. Wired earphone interface 122 places the translated result in registers and sets an interrupt. Host 120 reads these registers to determine into which operation mode the host should change.

In one embodiment, when a button is pressed or a transducer signal is received, tone generator 340 generates a supersonic frequency sequence between 75 kHz and 300 kHz. A unique frequency sequence is used for the press of each button and the repositioning detection signal. The supersonic signals can be easily separated from the audible signal generated by microphone 131.

Figure 4:
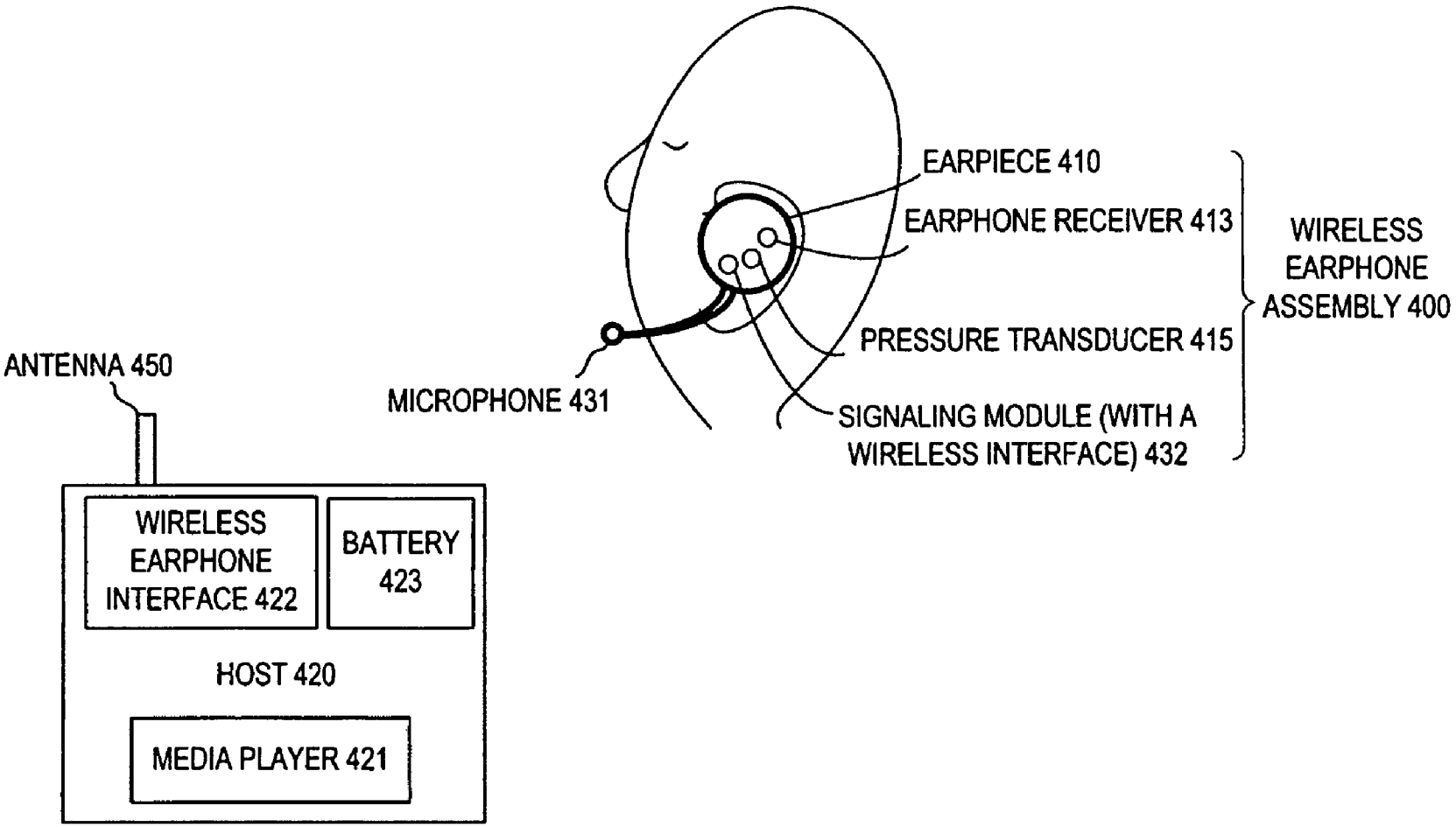
FIG. 4 illustrates another embodiment of an earphone assembly that communicates with a host using a wireless connection.

FIG. 4 illustrates another embodiment of an earphone assembly 400, which may also be viewed as a wireless headset which communicates with a host 420 using a radio frequency (RF) or infra-red (IR) transmission link. Signals transmitted on this wireless link can be encoded according to a wireless protocol, such as FM, Bluetooth or Wi-Fi. In this embodiment, earphone assembly 400 comprises an earpiece 410 for delivering audio signals to a user's ear. When placed in the ears, earpieces 410 may be positioned outside the ear canals, or within the ear canals with the ear canals entirely or partially sealed. Earpiece 410 includes an earphone receiver 413, which can also be referred to as an earphone speaker, for converting the electric signal into sound to be heard by the user. Earpiece 410 is physically connected to a microphone 431, which picks up the user's speech, as a microphone signal, and transmits the microphone signal to a signaling module 432 in earpiece 410. Signaling module 432 encodes the microphone signal into a encoded data sequence and modulates a host-bound wireless signal with such a sequence, according to a standard wireless protocol.

Earpiece 410 also includes a pressure transducer 415 (e.g., a microphone), which is similar or the same as pressure transducer 115 of FIG. 1. When a user removes earpiece 410, or re-inserts earpiece 410 into the ear, pressure transducer 415 detects a pressure change in the ear. Pressure transducer 415 converts the pressure change into an electric signal (referred to as a transducer signal), and sends the transducer signal to signaling module 432. In response to the transducer signal, signaling module 432 generates a repositioning detection signal to host 420, via a wireless interface that transmits the signal using a predetermined wireless protocol. For example, signaling module 432 can insert a pre-designated data sequence in the host-bound wireless signal to indicate the presence of the repositioning detection signal.

Host 420 has an antenna 425 for receiving the repositioning detection signal, and for transmitting audio signals (e.g., music) to earpiece 410, via a wireless link. Host 420 includes a media player 421, a wireless earphone interface 422 to demodulate the received, host-bound wireless signal to extract the repositioning detection signal, and a battery 423. Media player 421 may be similar or the same as media player 121 of FIG. 1. Host 420 may be powered by battery 423, or may be powered by a standard power cord that plugs into an electric outlet.

Upon detection of the repositioning detection signal, wireless earphone interface 422 decodes the signal and sends the decoded information to host 420. In response to the decoded information, the host 420 changes an operation mode of media player 421 or host 420. For example, media player 421 may be paused when it is in a play mode, or may resume playing when it is in a pause mode. Host 420 may switch from a receiver mode into a speaker mode, or vice versa, upon receipt of the repositioning detection signal.

Figure 5:
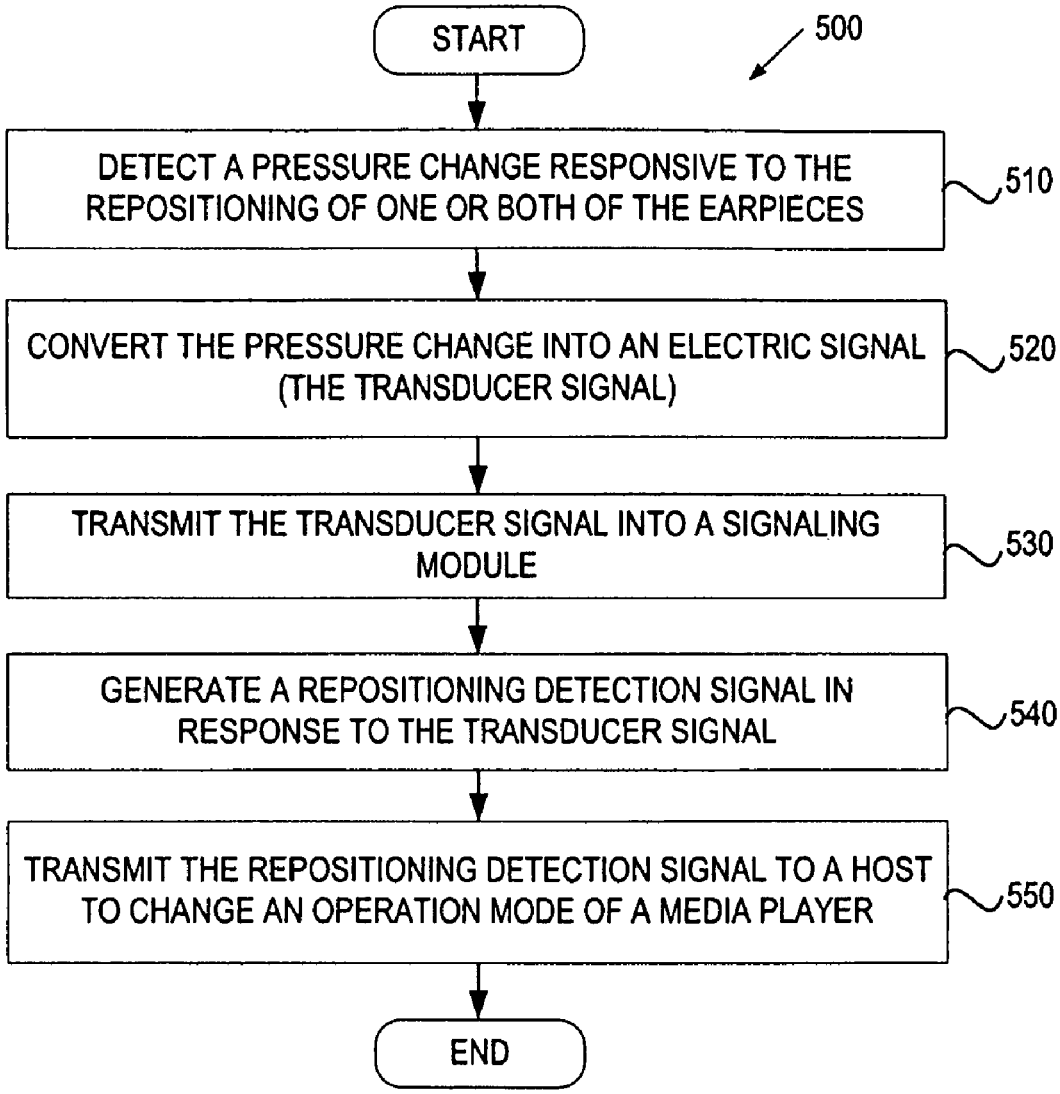
FIG. 5 illustrates a flow diagram of a method for detecting the repositioning of an earphone according to one embodiment of the present invention.

FIG. 5 shows a flow diagram of a method 500 for detecting the repositioning of an earphone according to one embodiment of the present invention. Method 500 may be performed by hardware (e.g., circuitry, dedicated logic, programmable logic, microcode, etc.), software (such as instructions on a computer readable storage medium executable by a processing device), or a combination thereof. In one embodiment, method 500 is performed by earphone assembly 100 and signaling module 122 of FIG. 1, or earphone assembly 400 of FIG. 4.

At block 510, a pressure transducer (e.g., pressure transducer 115 of FIG. 1 or pressure transducer 415 of FIG. 4) within an earphone assembly detects a pressure change responsive to the repositioning of one or both of the earpieces. At block 520, the pressure transducer converts the pressure change into an electric signal (i.e., the transducer signal). At block 530, the pressure transducer sends the transducer signal to a signaling mechanism, such as signaling module 132 of FIG. 3 or signaling module 432 of FIG. 4. At block 540, the signaling mechanism generates a repositioning detection signal in response to the transducer signal. At block 550, the signaling mechanism transmits the repositioning detection signal to a host (e.g., host 120 of FIG. 1 or host 420 of FIG. 4). In response to the repositioning detection signal, the host changes an operation mode of the host or a media player within the host.

An embodiment of the invention may be a machine-readable medium having stored thereon instructions which cause a programmable processor to perform operations as described above. A "machine-readable" medium may include a computer-readable storage medium and any medium that can store or transfer information. Examples of a machine readable medium include a ROM, a floppy diskette, a CD-ROM, a DVD, flash memory, hard drive, an optical disk or similar medium. In other embodiments, the operations might be performed by specific hardware components that contain hardwired logic. Those operations might alternatively be performed by any combination of programmed computer components and custom hardware components.

The applications of the present invention have been described largely by reference to specific examples and in terms of particular allocations of functionality to certain hardware and/or software components. However, those of skill in the art will recognize that automatically detecting the repositioning of an earphone, and responding to it by changing operation of the host, can also be made by software and hardware that distribute the functions of embodiments of this invention differently than herein described. Such variations and implementations are understood to be made without departing from the broader spirit and scope of the invention as set forth in the following claims. The specification and drawings are, accordingly, to be regarded in an illustrative sense rather than a restrictive sense.

What is claimed is:

1. An apparatus comprising:

an earphone that is to be coupled to a host;

a pressure transducer within the earphone; and a microphone; and a signaling mechanism coupled to the microphone and the pressure transducer, the signaling mechanism to send to the host a repositioning detection signal representing a pressure change detected by the pressure transducer, the pressure change responsive to repositioning of the earphone, wherein the signaling mechanism is to generate the repositioning detection signal for transmission to the host, the repositioning detection signal generated as a distinct direct current (DC) voltage level upon detection that the microphone is not in use, and as a supersonic distinct alternating current (AC) frequency sequence upon detecting that the microphone is in use.

2. The apparatus of claim 1, wherein the signaling mechanism comprises a signal generator to generate the supersonic distinct AC frequency sequence as the repositioning detection signal, the supersonic distinct AC frequency sequence to be superimposed on a microphone signal generated by the microphone for transmission to the host.

3. The apparatus of claim 1, wherein the supersonic distinct AC frequency sequence is in the range 75 kHz-300 kHz.

4. The apparatus of claim 1, wherein the signaling mechanism comprises:

a host interface to transmit a unique voltage level that identifies an occurrence of the repositioning detection signal.

5. The apparatus of claim 1, further comprising:

the host; and an earphone interface within the host to receive the repositioning detection signal and to change an operation mode of the host upon receipt of the repositioning detection signal.

6. The apparatus of claim 1, further comprising:

one or more buttons coupled to the signaling mechanism, the signaling mechanism to generate a button press signal when one of the buttons is pressed, the button press signal to be transmitted to the host through a same wire as the repositioning detection signal.

7. The apparatus of claim 1, wherein the host comprises:

a media player, which is to pause playing a media file in response to the repositioning detection signal indicating that the earphone has been removed from an ear.

8. The apparatus of claim 1, wherein the host comprises:

a media player, which is to resume playing a media file in response to the repositioning detection signal indicating that the earphone has been inserted into an ear.

9. The apparatus of claim 1, further comprising:

a plurality of wires to connect the signaling mechanism and the earphone with the host, the plurality of wires to carry audio signals from the host to the earphone, and the repositioning detection signal from the earphone to the host.

10. A method comprising:

detecting a pressure change within an earphone, the pressure change responsive to repositioning of the earphone, wherein the earphone is coupled to a microphone;

in response to the pressure change, generating a repositioning detection signal to a host that is coupled to the earphone, the repositioning detection signal generated as a distinct direct current (DC) voltage level upon detection that the microphone is not in use, and as a supersonic distinct alternating current (AC) frequency sequence upon detection that the microphone is in use; and sending the repositioning detection signal to the host to cause the host to change an operating mode.

11. The method of claim 10, further comprising:

generating the repositioning detection signal as a unique voltage level in response to the pressure change; and transmitting the unique voltage level to the host via a conductive wire.

12. The method of claim 10, further comprising:

generating the repositioning detection signal as the supersonic distinct AC frequency sequence in response to the pressure change;

superimposing the supersonic distinct AC frequency sequence on an audible signal generated by the microphone that is coupled to the earphone; and transmitting the superimposed supersonic and audio signals to the host through a conductive wire.

13. The method of claim 10, further comprising:

transmitting the repositioning detection signal through a same wire as an audible signal generated by the microphone.

14. The method of claim 10, further comprising:

causing a media player in the host to pause playing a media file in response to the repositioning detection signal indicating that the earphone has been removed from an ear.

15. The method of claim 10, further comprising:

causing a media player in the host to resumes playing a media file in response to the repositioning detection signal indicating that the earphone has been inserted into an ear.

16. A system comprising:

means for detecting a pressure change within an earphone that is coupled to a microphone;

means for generating a repositioning detection signal generated as a distinct direct current (DC) voltage level upon detecting that the microphone is not in use, and as a supersonic distinct alternating current (AC) frequency sequence upon detecting that the microphone is in use; and means for sending the repositioning detection signal representing the pressure change to a host, the pressure change responsive to repositioning of the earphone.

17. The system of claim 16, further comprising:

means for generating a uniquely identifiable signal as the repositioning detection signal, the uniquely identifiable signal to be transmitted to the host, through a single wire, with a microphone signal generated by the microphone.

* * * * *